US008378243B2

(12) United States Patent
Ahlert et al.

(10) Patent No.: US 8,378,243 B2
(45) Date of Patent: Feb. 19, 2013

(54) ARRANGEMENT COMPRISING AT LEAST TWO SEPARATE SWITCH POLE HOUSINGS AND HAVING A JOINING FACILITY FOR JOINING THE SWITCH POLE HOUSINGS AND A MULTI-POLE ELECTRIC SWITCHING DEVICE COMPRISING SUCH AN ARRANGEMENT

(75) Inventors: Torsten Ahlert, Fürstenwalde (DE); Jörg-Uwe Dahl, Werder (DE); Ludvik Godesa, Berlin (DE); Marc Liebetruth, Glienicke (DE)

(73) Assignee: Siemens Aktiengesellschaft, Munich (DE)

( * ) Notice: Subject to any disclaimer, the term of this patent is extended or adjusted under 35 U.S.C. 154(b) by 252 days.

(21) Appl. No.: 12/892,248

(22) Filed: Sep. 28, 2010

(65) Prior Publication Data

US 2011/0073448 A1 Mar. 31, 2011

(30) Foreign Application Priority Data

Sep. 30, 2009 (DE) ..... 10 2009 048 671

(51) Int. Cl.
*H01H 9/00* (2006.01)

(52) U.S. Cl. ..... 200/293; 200/303; 200/307; 335/161; 361/634; 361/673

(58) Field of Classification Search ..... 200/400, 200/401, 293, 303, 307, 50.32–50.4; 361/634, 361/637, 645, 673; 218/2–6, 22, 155; 335/160, 335/161, 202; 403/278, 279, 292, 294
See application file for complete search history.

(56) References Cited

U.S. PATENT DOCUMENTS

| | | | | |
|---|---|---|---|---|
| 4,004,197 | A * | 1/1977 | Hawkes, Jr. | 361/636 |
| 4,954,798 | A * | 9/1990 | Kasahara et al. | 335/161 |
| 5,001,315 | A * | 3/1991 | Runyan et al. | 200/307 |
| 5,298,874 | A | 3/1994 | Morel et al. | |
| 6,064,018 | A | 5/2000 | Seymour et al. | |

(Continued)

FOREIGN PATENT DOCUMENTS

| | | |
|---|---|---|
| DE | 2516527 | 10/1976 |
| DE | 7711221 | 8/1977 |

(Continued)

OTHER PUBLICATIONS

German priority document DE 10 2009 048 671.2, filed Sep. 30, 2009, not yet published.

(Continued)

*Primary Examiner* — Michael Friedhofer
(74) *Attorney, Agent, or Firm* — Harness, Dickey & Pierce, P.L.C.

(57) ABSTRACT

An arrangement including at least two separate switch pole housings and a joining facility for joining the switch pole housings. Each of the switch pole housings forms an insulating enclosure of a switching space for receiving a single switch pole of an electric switching device. A side wall of a first switch pole housing, facing a second one of the switch pole housings, includes at least one recess for receiving at least one joining device of the joining facility. The at least one recess forms a first undercut with respect to a side wall and a first locating surface in parallel with a front wall of the housing. The at least one joining device engages behind the first undercut and is braced against a first locating surface.

13 Claims, 4 Drawing Sheets

U.S. PATENT DOCUMENTS

| | | | | |
|---|---|---|---|---|
| 6,246,022 | B1 | 6/2001 | Faber et al. | |
| 6,278,605 | B1 * | 8/2001 | Hill | 361/600 |
| 6,431,909 | B1 * | 8/2002 | Nolden et al. | 439/532 |
| 6,696,654 | B2 * | 2/2004 | Ashani et al. | 200/307 |
| 6,930,573 | B2 * | 8/2005 | Ciarcia et al. | 335/8 |
| 7,116,194 | B2 | 10/2006 | Azzola et al. | |
| 7,683,277 | B2 * | 3/2010 | Sellner et al. | 200/293 |
| 2005/0051414 | A1 * | 3/2005 | Subramanian et al. | 200/401 |
| 2005/0068131 | A1 | 3/2005 | Azzola et al. | |
| 2007/0238356 | A1 | 10/2007 | Sellner et al. | |

FOREIGN PATENT DOCUMENTS

| | | | |
|---|---|---|---|
| DE | 3426949 | | 1/1986 |
| DE | 8804649.4 | | 6/1988 |
| DE | 29703565 | | 4/1997 |
| DE | 69217441 | T2 | 7/1997 |
| DE | 69927335 | | 6/2006 |
| DE | 60211028 | | 10/2006 |
| DE | 60211028 | T2 | 10/2006 |
| DE | 102006019577 | | 10/2007 |
| EP | 0310474 | | 4/1989 |
| EP | 1464063 | B1 | 4/2006 |
| EP | 2139017 | | 12/2009 |
| WO | WO 03/050835 | | 6/2003 |

OTHER PUBLICATIONS

Office Action for corresponding German patent application No. 10 2009 048 671.2 dated Sep. 7, 2012.

* cited by examiner

ARRANGEMENT COMPRISING AT LEAST TWO SEPARATE SWITCH POLE HOUSINGS AND HAVING A JOINING FACILITY FOR JOINING THE SWITCH POLE HOUSINGS AND A MULTI-POLE ELECTRIC SWITCHING DEVICE COMPRISING SUCH AN ARRANGEMENT

PRIORITY STATEMENT

The present application hereby claims priority under 35 U.S.C. §119 on German patent application number DE 10 2009 048 671.2 filed Sep. 30, 2009 the entire contents of which are hereby incorporated herein by reference.

FIELD

At least one embodiment of the invention generally relates to the constructional design of an arrangement comprising at least two separate switch pole housings and having a joining facility for joining the switch pole housings. At least one embodiment of the invention also generally relates to a multi-pole electric switching device comprising such an arrangement.

BACKGROUND

Electric switching devices, for example low-voltage circuit breakers in the form of so-called compact switches, known as MCCBs (for molded case circuit breakers) of in the form of so-called open circuit breakers, known as ACBs (for air circuit breakers), break/connect single- or multi-phase current paths by mechanically opening/closing single- or double-breaking/-closing switch contacts. In this context, the switch contacts must be arranged in an electrically insulated manner.

This insulation must be effected both with respect to the installation environment and—in the case of multi-phase electric switching devices—between the individual phases. To achieve this, the parts of the electric switching device which are in each case associated with one such phase of the main circuit and in each case form one switch pole (this includes, in particular, the switch contacts of the respective switch pole) are in each case installed in a separate switching space which is bounded by an insulating enclosure. These insulating enclosures consisting especially of plastic, which also include a large number of rigid housing arrangements differing in their external appearance, at the same time prevent the unrestricted spreading of the gas and particle releases produced during switching processes.

Thus, these insulating enclosures essentially consist, for example in the case of a known housing arrangement, of a housing base, chambered in accordance with the number of switch poles, and an adequate housing top which, as a rule, are joined together by screw connections.

With the application of rotational twin contacts (contact bridges), another housing concept became established in which a switchable, double-breaking contact bridge together with two arc-quenching chambers and possibly still other components needed for each switch pole (slot motor etc.) are arranged in an almost closed cassette consisting in most cases of at least two half shells. These prefabricated single-pole cassettes must then be combined to form switches having the number of poles needed in each case. This combination should be effected whilst maintaining a preferred direction and as few parts as possible and ensuring maximum stability. In this context, the modularity of the individual poles should be maintained.

From the German translation DE 602 11 028 T2 of the European patent specification EP 1 464 063 B1, the entire contents of each of which are incorporated herein by reference, an electric switching device in the form of a low-voltage circuit breaker is known which has such a generic arrangement. In this known arrangement, each of the switch pole housings forms an insulating enclosure of a switching space for accommodating a single switch pole of the electric switching device. In this arrangement, the insulating enclosure has a lower wall, an upper wall, two side walls, a rear wall and a front wall. To provide a joint with other switch pole housings which is reliable with regard to the acting forces and at the same time to avoid complicated joining operations, the at least two switch pole housings are formed of two half shells which rest against one another along a partition joint, the partition joint extending in parallel with the side walls of the switch pole housings. In this arrangement, one of these half shells has on its coupling surface facing the other half shell several hollow pins which protrude transversely from the coupling surface whilst the other one of the two half shells has through-holes correlated with the pins which are suitable for accommodating the hollow pins. In this arrangement, the mutual couplings between the pins and the corresponding holes form insulating ducts which extend transversely through the switch pole housings with respect to the side walls. In this arrangement, the switch poles are connected via clamping and cross-linking elements which extend through the insulating ducts.

SUMMARY

At least one embodiment of the invention is also based on creating a joint of the switch pole housings which is reliable with regard to the forces acting during the switching and, at the same time, to avoid complicated assembly operations. In this context, however, a preferred assembly direction—namely transversely to the front walls of the switch pole housings—should be maintained additionally.

According to at least one embodiment of the invention, the at least one recess forms a first undercut with respect to the first one of the side walls and a first locating surface in parallel with the front wall, at least one joining device being constructed as contour element in such a manner that it engages behind the first undercut and is braced against the first locating surface, and the contour element having a receiving opening extending in parallel with the first one of the side walls, for receiving at least one fastening device of the joining facility.

In an example embodiment, it is then provided that the recess is open toward the rear wall so that the contour element can be pushed into the recess from the rear wall and the fastening means can be pushed into the receiving opening of the contour element from the front wall.

In order to be able to attach at the same time also a front insulating cover without additional fastening devices in one assembly step, it is preferably provided that the front insulating cover has a corresponding receiving opening extending flush with the receiving opening of the contour element. This insulating cover preferably forms a stop for the at least one fastening device.

The contour element can be molded integrally on the second one of the switch pole housings in a master molding process.

However, there may also be a technical necessity to construct the contour element separately from the two switch pole housings, wherein the second one of the switch pole housings then preferably has a second recess for receiving the at least one joining device of the joining facility analogously to the first one of the switch pole housings on a second one of the side walls facing the first one of the switch pole housings, the recess forming a second undercut with respect to the second one of the side walls and a second locating surface in parallel with the front wall, and the contour element being constructed in such a manner that it engages behind the second undercut and is braced against the second locating surface.

As is already known from DE 602 11 028 T2, the entire contents of which are incorporated herein by reference, the at least two switch pole housings can be formed of two half shells which rest against one another along a partition joint, the partition joint extending in parallel with the side walls of the switch pole housings.

In the arrangement according to at least embodiment of the invention, however, the at least two switch pole housings can also be formed of two half shells which rest against one another along a partition joint, the partition joint extending perpendicularly to the side walls and perpendicularly to the front walls of the switch pole housings. In this case, it is even possible, at the same time also to attach the two mutually correlated half shells to one another by means of the contour element if the contour element in each case forms an undercut in each one of the two half shells.

BRIEF DESCRIPTION OF THE DRAWINGS

Embodiments of the novel arrangement and an electric switching device comprising the novel arrangement are shown in FIGS. 1 to 7, in which.

DETAILED DESCRIPTION OF THE EXAMPLE EMBODIMENTS

Figure 1:
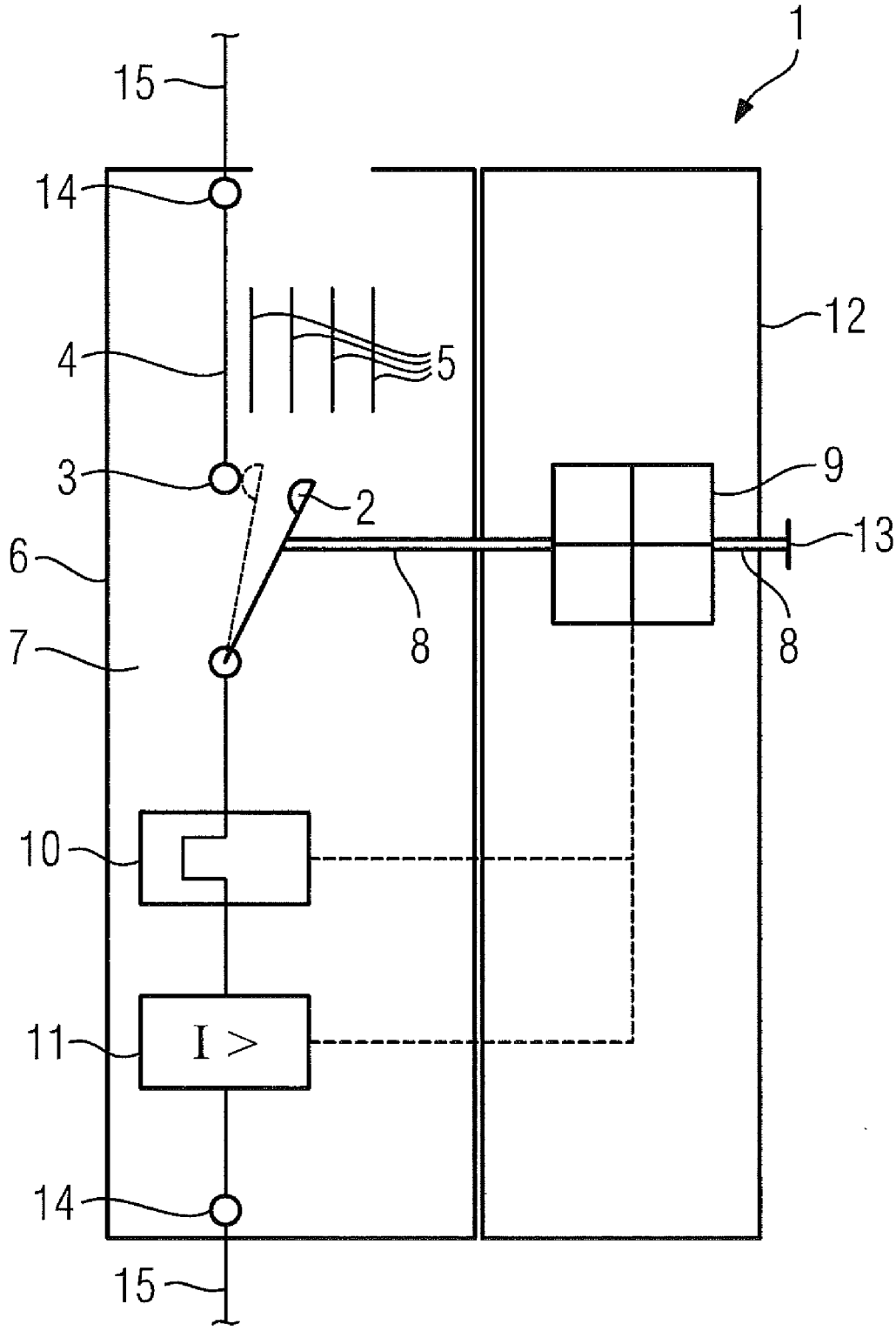
FIG. 1 shows a diagrammatic representation of an electric switching device in a section through a switch pole housing which forms an insulating enclosure of a switching space.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to the basic diagram of the electric switching device 1 according to an embodiment of the invention shown in FIG. 1, the switching device has switching members in the form of switch contacts 2, 3 for breaking a first current path 4 of a first switch pole, the current path 4 being part of a first main current path of a power distribution network—particularly a low-voltage network. The switch contacts 2, 3 are associated with an arc quenching member in the form of an arc-splitter stack 5. The electric switching device has a first switching space 7, bounded by a first switch pole housing 6, for receiving the switch contacts 2, 3 of the first switch pole. Drive members forming a drive mechanism 8 of the electric switching device are used for opening and closing the switch contacts 2, 3.

Furthermore, the electric switching device has a disconnecting mechanism 9 in the form of a switch lock arranged as mechanical intermediate member between the switch and drive members as part of the drive mechanism 8. In the electric switching device, trip members are provided which trip the disconnecting mechanism 9—that is to say detach the latching of the switch lock—in order to start the drive mechanism 8 to open the switch contacts 2, 3. The trip members provided are, in particular, a thermal trip 10 (as overload detector), an electromagnetic trip 11 (as short circuit detector) and a manual trip 13 protruding from a front insulating cover 12, by means of which the switch lock can be released to open the switch contacts. However, it is also possible to provide a pressure trip or an electronic trip (as overload and/or short circuit detector)—that is to say an ETU (electronic trip unit).

The electric switching device 1 also has in each case in parallel with the first switching space 7 shown in FIG. 1 further switching spaces bounded by further separate switch pole housings in which switch contacts of further switch poles are arranged. The ends of the current path 4 of each of the switch poles are in each case connected electrically to at least one electric line 15 of the respective main current path of the power distribution network by means of line terminals 14.

According to FIGS. 2 and 3, 4 and 5 and 6 and 7, all three of the embodiments 101; 201 and 301 respectively, of the multi-pole switching device according to an embodiment of the invention, shown there, which are in each case configured as three-pole low-voltage circuit breakers in the form of a compact switch, have a first, second and third embodiment 116; 216 and 316, respectively, of an arrangement of in each case three separate switch pole housings 106; 206 and 306, respectively, and in each case two joining facilities 117; 217 and 317, respectively, for joining the switch pole housings. The three switch pole housings 106; 206 and 306, respectively in each case form an insulating enclosure of a switching space, one of the three switch poles being arranged in each of the switching spaces. In this arrangement, in each case two adjacent ones of the three separate switch pole housings 106; 206 and 306, respectively, are mechanically joined by way of one of the two joining facilities 117.

Each of the insulating enclosures formed by one of the switch pole housings 106; 206 and 306, respectively, has a lower wall 118, an upper wall 119; 219 and 319, respectively, two side walls 120, 121; 220, 221 and 320, 321, respectively, a rear wall 122; 222 and 322, respectively, and a front wall 123; 223 and 323, respectively. In each case a first one of the adjacent switch pole housings is provided on a first 120 of the side walls facing the adjacent second one of the switch pole housings with two recesses 124; 224; 324 open toward the rear wall, which form a part of the joining facility 117; 217; 317. These recesses 124; 224; 324, which are used for receiving joining devices of the joining facility, form first undercuts 126; 226; 326 with respect to the first 120; 220; 320 of the side walls and first locating surfaces 127; 227; 327 in parallel with the front wall 123; 223; 323.

The joining devices are configured as contour elements 125; 225; 325 in such a manner that they engage behind the first undercuts 126; 226; 326 and are braced against the first locating surfaces 127; 227; 327. The contour elements 125; 225; 325 and the first undercuts 126; 226; 326 are thus matched to one another in such a manner that after the joining together, a lateral relative movement of the switch pole housings 106; 206 and 306, respectively, is prevented.

The contour elements 125; 225; 325 in each case have a receiving opening 128; 228; 328 extending in parallel with the first 120; 220; 320 of the side walls for receiving in each case one fastening device 129; 229; 329 of the joining facility 117; 217; 317.

To reduce the installation effort, the fastening devices 129; 229; 329 are at the same time used for also fastening a front insulating cover 112; 212; 312, used in a conventional manner for receiving accessories, at the switch pole housings, the separate fastening of which can thus be omitted. For this purpose, the front insulating cover has corresponding receiving openings 130; 230; 330 extending flush towards the receiving openings 128; 228; 328 of the contour elements 125; 225; 325; which in each case form a stop 231; 331 for the engaging fastening devices 129; 229; 329.

Figure 2:
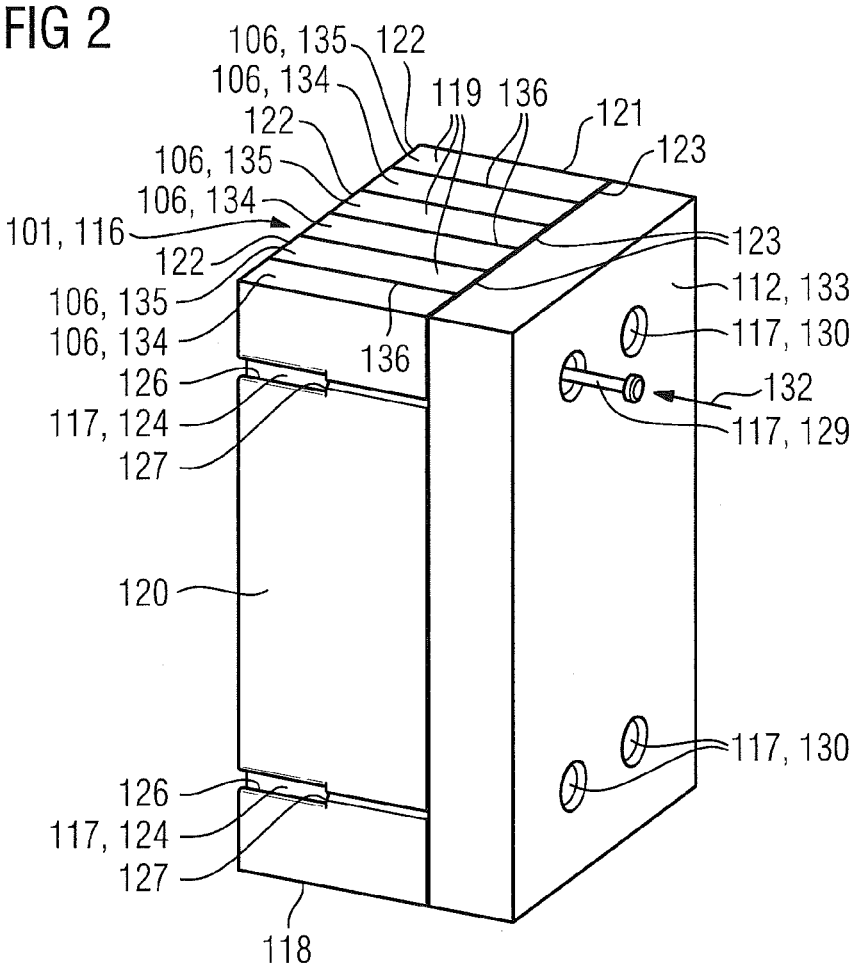
FIG. 2 shows a first embodiment according to an embodiment of the invention of the switching device in a perspective representation comprising three separate switch pole housings, an insulating cover and a first embodiment of a joining facility according to an embodiment of the invention for joining the three switch pole housings and the insulating cover.
Figure 3:
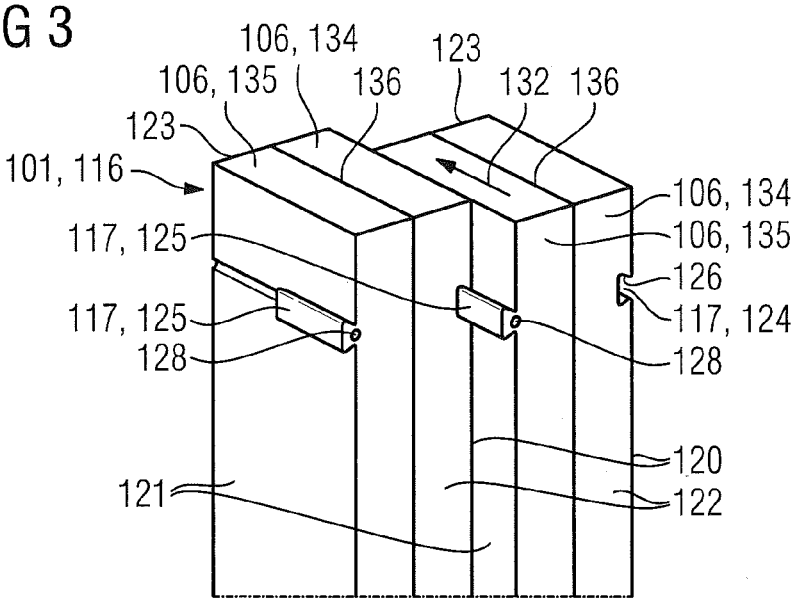
FIG. 3 shows the installation of two of the switch pole housings of the first embodiment of the switching device by way of the first embodiment of the joining facility.

In the first embodiment 116 of the arrangement shown in FIGS. 2 and 3, the contour elements 125 in each case have the shape of a projection extending in parallel with the side wall 121, with dovetail-shaped cross-sectional shape and are integrally molded on the side wall 121 of the switch pole housing 106 by way of a master molding process. Correspondingly, a section, open toward the rear wall, of the in each case associated recess 224 is configured as a corresponding groove with dovetail-shaped cross-sectional shape extending in parallel with the side wall 120, which forms the undercuts 126.

Figure 4:
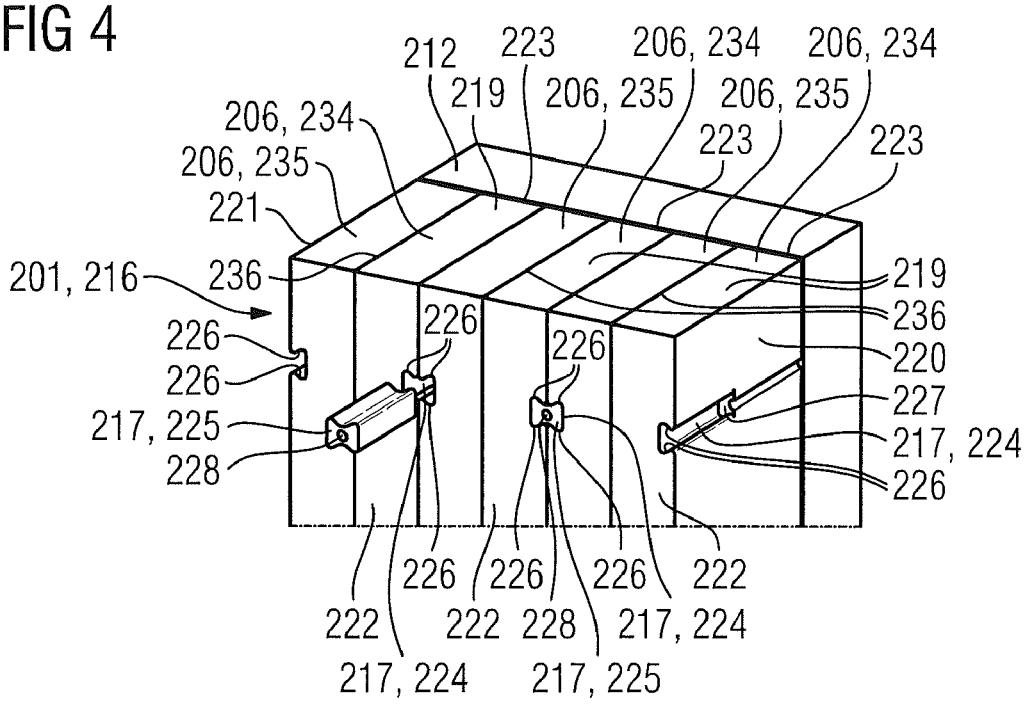
FIGS. 4 and 5 show the installation of switch pole housings of a second embodiment of the switching device by way of a second embodiment of the joining facility.
Figure 5:
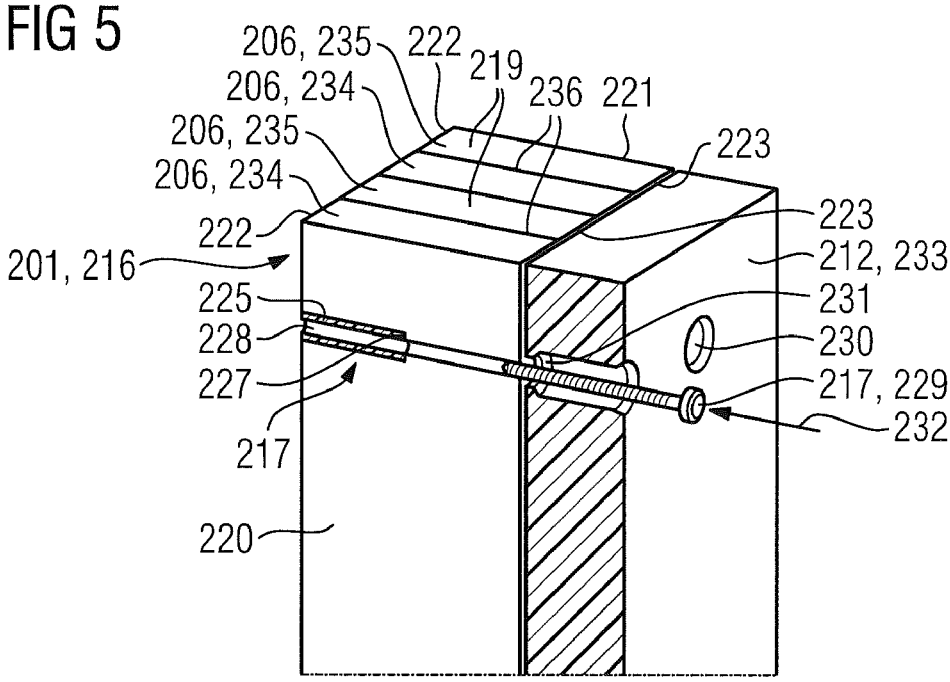
Figure 6:
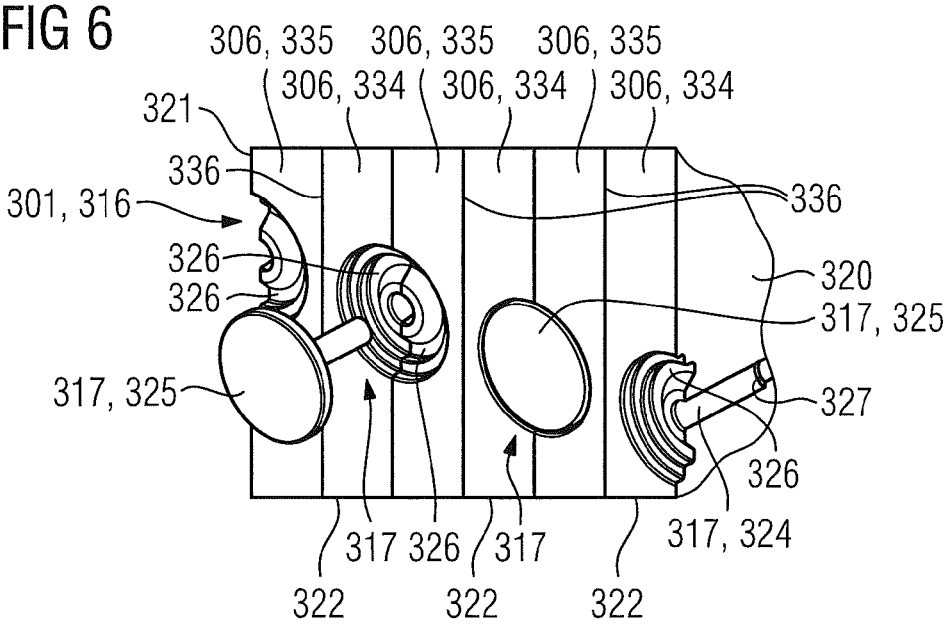
FIGS. 6 and 7 show the installation of switch pole housings of a third embodiment of the switching device by way of a third embodiment of the joining facility.
Figure 7:
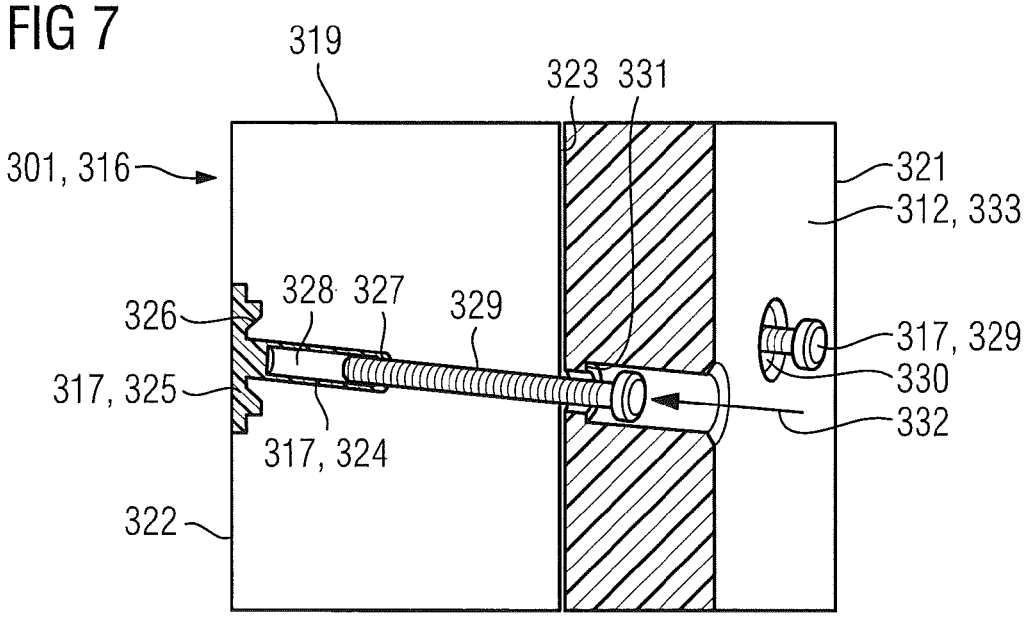

In the second embodiment 216, shown in FIGS. 4 and 5, and in the third embodiment 316, shown in FIGS. 6 and 7, of the arrangement of the multi-pole switching device 201 and 301, respectively, according to the invention, the contour element 225 and 325, respectively, is in each case constructed separately to the switch pole housings 206 and 306, respectively, and the switch pole housings in each case have two of the said recesses 224 and 324, respectively, for receiving the contour elements 225 and 325 on both side walls 220, 221; and 320, 321, respectively.

In the second embodiment 216 of the arrangement, the contour elements 225 are in each case configured as a pin extending in parallel with the side walls 220, 221, the cross section of which is shaped in the manner of a double dovetail. A section, open toward the rear wall, of the associated recesses 224 is correspondingly in each case configured as a corresponding groove, extending in parallel with the side walls 220, 221, with dovetail-shaped cross-sectional shape which forms the undercuts 226.

In the third embodiment 316 of the arrangement, the contour elements 325 are in each case configured as a plug-in element which has a head which can be lowered from the direction of the rear wall 322 of the switch pole housing in the associated recess 324. In this arrangement, the head is provided with an annular projection extending in the direction of the front wall 323. Correspondingly, the recesses 324 are in each case open toward the rear wall 322 and have at their bottom an annular groove corresponding with the annular projection.

The fastening devices 129; 229; 329 are usually screw connections. It is possible to screw thread-forming screws directly into the receiving opening 128. But it is also conceivable to insert threaded inserts into the receiving openings of the contour elements. The fastening devices can also be configured as rivet joint. In every case, the switch pole housings and the insulating cover are installed in a preferred installation direction 132; 232; 332 which extends in parallel with the side walls 120, 121; 220, 221; 320, 321 starting from a front side 133; 233; 333 of the insulating cover.

In the three embodiments 116; 216; 316 of the arrangement which are shown, the switch pole housings 106; 206; 306 are in each case formed of two half shells 134, 135; 234, 235; 334, 335 which rest against one another along a partition joint 136; 236; 336 extending in parallel with the side walls of the switch pole housings.

However, the switch pole housings can also be formed of two half shells which rest against one another along a partition joint extending perpendicularly to the side walls and perpendicularly to the front walls. In this arrangement, the contour element could then form an undercut in each case in each of the two half shells.

In the arrangements according to an embodiment of the invention, the switch pole housings 106; 206; 306 (of the single-pole cassettes) are combined without additional large-volume external housing. The installation can be carried out in the preferred installation direction 132; 232; 332 and the number of joining elements and thus the installation effort are reduced by the "combined installation" of the front insulating cover 112; 212; 312. No cross connection is required through the switching spaces and the associated insulation problems do not apply.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An arrangement comprising:

at least two separate switch pole housings; and a joining facility for joining the at least two switch pole housings, each of the at least two switch pole housings forming an insulating enclosure of a switching space for receiving a single switch pole of an electric switching device, the insulating enclosure including a lower wall, an upper wall, two side walls, a rear wall and a front wall, at least a first one of the at least two switch pole housings including, on a first one of the side walls facing the second one of the switch pole housings, at least one recess for receiving at least one joining device of the joining facility, the at least one recess forming a first undercut with respect to the first one of the side walls and a first locating surface in parallel with the front wall, the at least one joining device being constructed as a contour element in such a manner to engage behind the first undercut and to be braced against the first locating surface, and the contour element including a receiving opening, extending in parallel with the first one of the side walls, for receiving at least one fastening device of the joining facility.

2. The arrangement as claimed in claim 1, wherein the recess is open toward the rear wall.

3. The arrangement as claimed in claim 2, wherein a front insulating cover includes a corresponding receiving opening extending flush toward the receiving opening of the contour element.

4. The arrangement as claimed in claim 3, wherein the insulating cover forms a stop for the at least one fastening device.

5. The arrangement as claimed in claim 1, wherein a front insulating cover includes a corresponding receiving opening extending flush toward the receiving opening of the contour element.

6. The arrangement as claimed in claim 5, wherein the insulating cover forms a stop for the at least one fastening device.

7. The arrangement as claimed in claim 1, wherein the contour element is molded integrally on the second one of the at least two switch pole housings.

8. The arrangement as claimed in claim 1, wherein the contour element is constructed separately from the at least two switch pole housings, the second one of the switch pole housings, analogously to the first one of the at least two switch pole housings, including on a second one of the side walls, facing the first one of the at least two switch pole housings, a second recess for receiving the contour element of the joining facility, the recess forming a second undercut with respect to the second one of the side walls and a second locating surface in parallel with the front wall, and the contour element being constructed in such a manner to engage behind the second undercut and being braced against the second locating surface.

9. The arrangement as claimed in claim 1, wherein the at least two switch pole housings are formed of two half shells which rest against one another along a partition joint, the partition joint extending in parallel with the side walls of the at least two switch pole housings.

10. The arrangement as claimed in claim 1, wherein the at least two switch pole housings are formed of two half shells which rest against one another along a partition joint, the partition joint extending perpendicularly to the side walls and perpendicularly to the front walls of the at least two switch pole housings.

11. The arrangement as claimed in claim 10, wherein the contour element forms an undercut in each one of the two half shells.

12. A multi-pole electric switching device, comprising:

at least two separate switch pole housings, each forming an insulating enclosure of a switching space; and at least two switch poles, each arranged in one of the switching spaces, the at least two separate switch pole housings being mechanically joined via a joining facility, the at least two switch pole housings and the joining facility being configured as an arrangement as claimed in claim 1.

13. A multi-pole electric switching device, comprising:

at least two separate switch pole housings, each forming an insulating enclosure of a switching space; and at least two switch poles, each arranged in one of the switching spaces, the at least two separate switch pole housings being mechanically joined at facing sidewalls of the at least two switch pole housings via a joining facility, the at least two switch pole housings and the joining facility being configured as an arrangement, wherein each of the sidewalls has at least one recess that extends into the switching space and the joining facility is insertable into each of the recesses and removable from each of the sidewalls.

* * * * *